US010996032B2

(12) United States Patent
Buttolph

(10) Patent No.: US 10,996,032 B2
(45) Date of Patent: May 4, 2021

(54) PRE-SLIT MEMBRANE SLOT COVER FOR A PROJECTILE

(71) Applicant: Simmonds Precision Products, Inc., Vergennes, VT (US)

(72) Inventor: Martin Edwy Buttolph, Middlebury, VT (US)

(73) Assignee: Simmonds Precision Products, Inc., Vergennes, VT (US)

( * ) Notice: Subject to any disclaimer, the term of this patent is extended or adjusted under 35 U.S.C. 154(b) by 621 days.

(21) Appl. No.: 15/950,771

(22) Filed: Apr. 11, 2018

(65) Prior Publication Data

US 2019/0316887 A1 Oct. 17, 2019

(51) Int. Cl.
*F42B 10/14* (2006.01)
*F42B 10/64* (2006.01)

(52) U.S. Cl.
CPC ..... *F42B 10/14* (2013.01); *F42B 10/64* (2013.01)

(58) Field of Classification Search
CPC ..... F42B 10/14; F42B 10/64; F42B 15/01; F42B 10/02; F42B 10/146; F42B 10/20; B64C 39/024; B64C 3/56
See application file for complete search history.

(56) References Cited

U.S. PATENT DOCUMENTS 6,382,563 B1 5/2002 Chiu
6,880,780 B1 * 4/2005 Perry ..... F42B 10/14 244/3.27
7,829,830 B1 * 11/2010 Rogers ..... F42B 10/20 244/3.27
8,258,447 B2 9/2012 Blake et al.
8,895,908 B2 * 11/2014 Barry ..... F42B 39/00 244/3.27
2004/0144888 A1 * 7/2004 Dryer ..... F42B 10/14 244/3.27
2010/0264254 A1 10/2010 Rogers
2012/0048992 A1 * 3/2012 Malul ..... F42B 10/14 244/3.24
2014/0312160 A1 10/2014 Blake et al.
2014/0312575 A1 * 10/2014 Barry ..... F42B 10/14 277/654
2016/0121992 A1 * 5/2016 Saroka ..... B64C 9/02 244/129.4
2016/0252333 A1 * 9/2016 Carlqvist ..... F42B 10/50 244/3.26
2017/0336184 A1 * 11/2017 Merems ..... F42B 10/14
2018/0112958 A1 * 4/2018 Willenbring ..... F42B 10/14
2018/0372464 A1 * 12/2018 Dylla ..... F42B 10/14

FOREIGN PATENT DOCUMENTS

WO 20120003025 A2 1/2012

OTHER PUBLICATIONS

Extended European Search Report dated Jul. 19, 2018, received for corresponding European Application No. 19167906.7.

* cited by examiner

*Primary Examiner* — Assres H Woldemaryam
(74) *Attorney, Agent, or Firm* — Kinney & Lange, P.A.

(57) ABSTRACT

A projectile includes a housing and a slot formed in the housing. A deployable flight surface is inside the housing. A cover is attached to the housing and covers the slot. A cutter is adjacent the cover and moves in the slot and slices the cover to open the slot and allow deployment of the flight surface through the slot.

20 Claims, 7 Drawing Sheets

PRE-SLIT MEMBRANE SLOT COVER FOR A PROJECTILE

BACKGROUND

The present disclosure relates to projectiles and seals for covering slots and holes in the fuselage of a projectile.

Aerial projectiles, such as rockets, missiles, and other similar munitions, utilize deployable flight surfaces to stabilize the projectiles in flight and/or to selectively guide and steer the projectiles during flight to their destinations and targets. These deployable flight surfaces include various fins, wings, canards, airfoils and the like, which are typically stowed inside the fuselage of a projectile prior to launch. With the flight surfaces stowed inside the fuselage, the projectile has a simple profile that allows compact storage of the projectile and launching of the projectile from a tube launcher or similar enclosure. The flight surfaces are deployed immediately or sometime after launch and extend through the fuselage via slots formed in the fuselage. In some projectile designs, the flight surfaces deploy immediately after exiting the launch tube or enclosure because the tube or enclosure was the only remaining impediment to deployment and the forces acting on the projectile cause the flight surfaces to deploy through the slots. In other more-complex designs, actuators are provided inside the fuselage that selectively deploy the flight surfaces through the slots.

While the slots in the fuselage allow deployment of the flight surfaces, the slots may also allow ingress of natural contaminants, such as moisture, dust, and ice, into the sensitive interior of the fuselage. The slots may also allow rocket motor exhaust created at launch to enter the fuselage, especially in systems where multiple projectiles are fired from the same launcher, such as the M270 Multiple Launch Rocket System.

Recently, attempts have been made to seal the slot while the flight surfaces are stowed. One method used in the past to seal the slots includes a frangible seal that is shattered or torn by the flight surface when the flight surface deploys. This method is undesirable because a relatively large and heavy actuator is required to generate enough force to not only deploy the flight surface but deploy the flight surface with enough force to break through the seal. Another method uses small charges to detach and blow off a cover from the slot. This method is disadvantageous because the method is complex and the exhaust from the charges may contaminate the interior of the projectile. Another method uses a retractable cover, however, this system requires the addition of actuators and additional space to accommodate the actuators and the retractable cover, which adds cost and complexity to the projectile. A seal is needed that is simple and does not require complex and/or heavy actuators to open the seal.

SUMMARY

In one aspect of the invention, a projectile includes a fuselage and a slot formed in the fuselage. The projectile also includes a flight surface deployable from an inside of the fuselage to an outside of the fuselage. A membrane is attached to the fuselage and covers the slot. A cutter is positioned and configured to move along a length of the slot to slice the membrane to allow deployment of the flight surface through the slot.

In another aspect of the invention, a projectile includes a housing and a slot formed in the housing. A deployable flight surface is inside the housing. A cover is attached to the housing and covers the slot. A cutter is adjacent the cover and moves in the slot and slices the cover to open the slot and allow deployment of the flight surface through the slot.

In another aspect of the invention, a method for deploying a flight surface through a slot formed on the outer housing of a guided projectile includes moving a cutter from a first end of the slot to a second end of the slot and slicing a membrane covering the slot as the cutter moves from the first end of the slot to the second end of the slot. The method also includes extending the flight surface through the sliced membrane and the slot.

Persons of ordinary skill in the art will recognize that other aspects and embodiments of the present invention are possible in view of the entirety of the present disclosure, including the accompanying figures.

Figure 1:
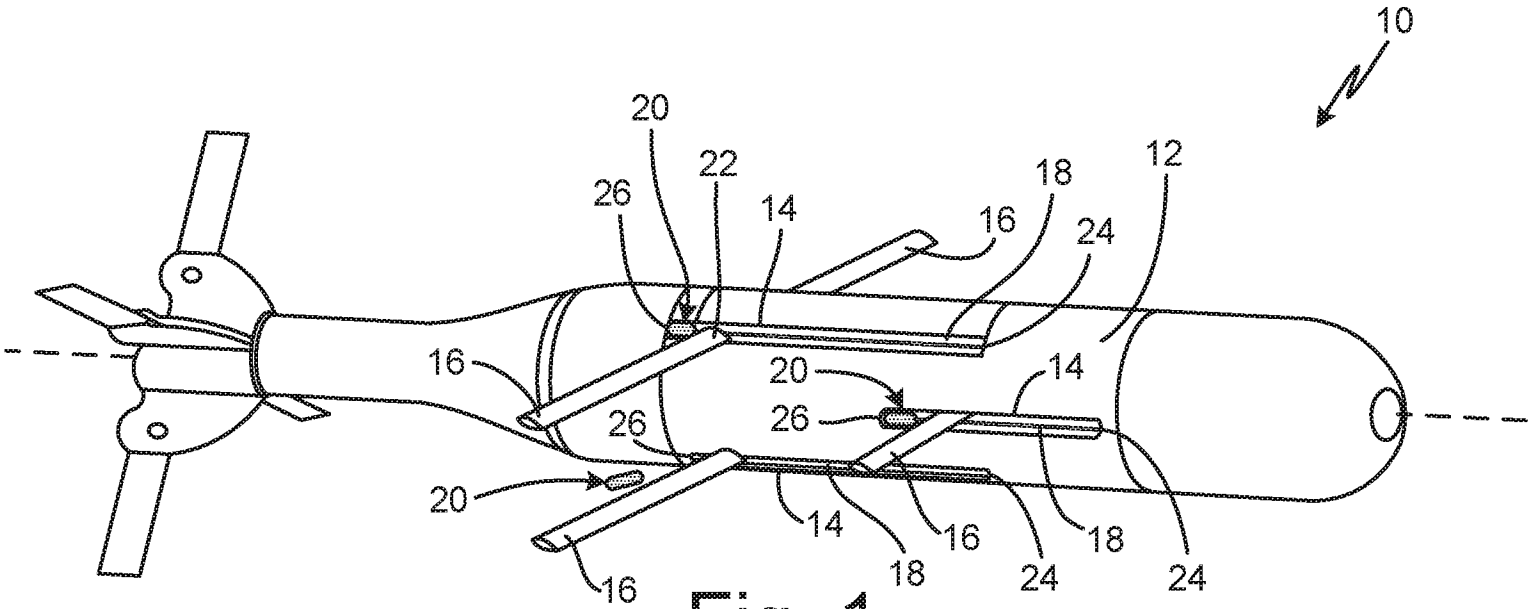
FIG. 1 is a perspective view of a guided projectile with flight surfaces in a deployed position.

While the above-identified drawing figures set forth one or more embodiments of the invention, other embodiments are also contemplated. In all cases, this disclosure presents the invention by way of representation and not limitation. It should be understood that numerous other modifications and embodiments can be devised by those skilled in the art, which fall within the scope and spirit of the principles of the invention. The figures may not be drawn to scale, and applications and embodiments of the present invention may include features and components not specifically shown in the drawings. Like reference numerals identify similar structural elements.

DETAILED DESCRIPTION

The present disclosure provides a projectile with slots formed in the fuselage of the projectile, and flight surfaces that are deployed through the slots after the projectile is launched. While the flight surfaces are stowed inside the projectile, membranes are attached to the fuselage and cover the slots to prevent outside contaminants from entering the fuselage through the slots prior to launch. As described below with reference to the Figures, the projectile also includes a cutter for each slot that slices the membrane during launch or after launch to allow each flight surface to deploy through the respective slot without undue or significant impediment from the membrane.

Figure 2A:
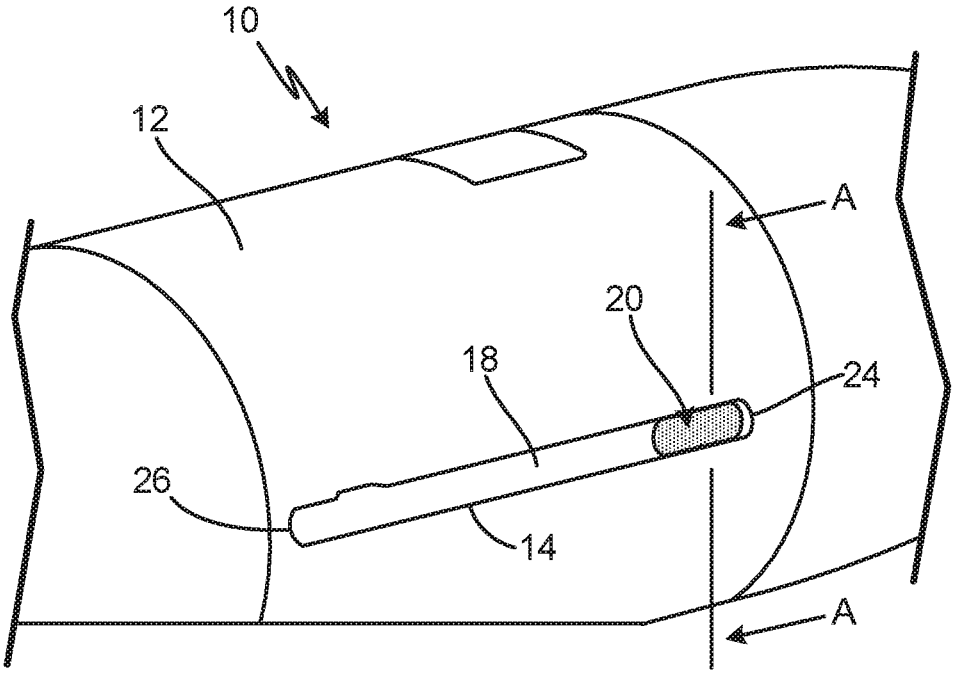
FIG. 2A is a perspective view of a projectile with a slot in the fuselage of the projectile, a cover sealing the slot, and a weighted cutter in the slot in a starting position.
Figure 2B:
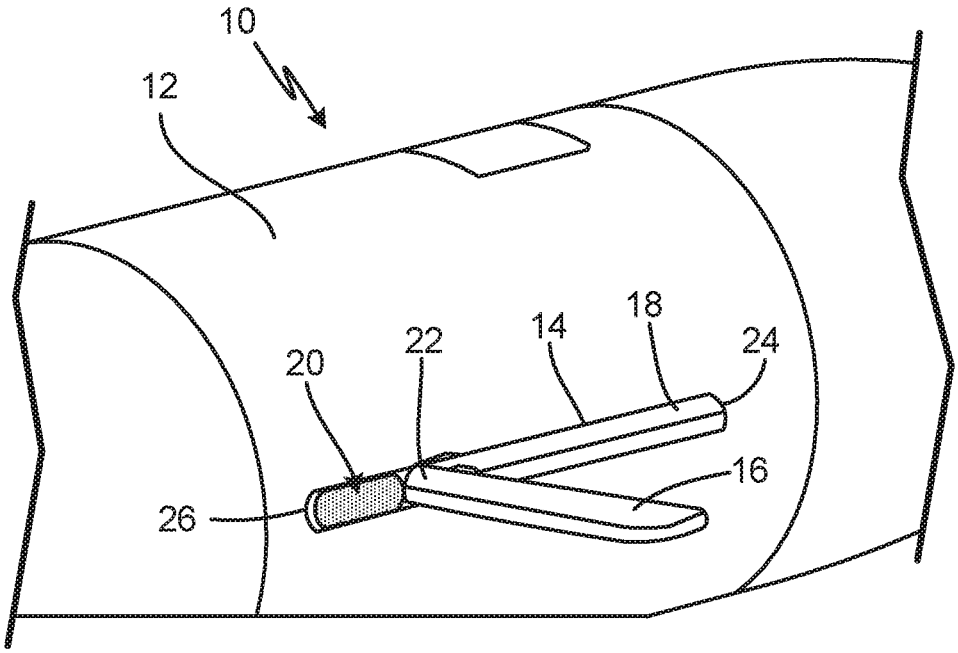
FIG. 2B is another perspective view of the projectile from FIG. 2A, with the weighted cutter in a final position and a flight surface extending through the slot in a deployed position.

FIGS. 1-2B will be discussed concurrently. FIG. 1 is a perspective view of projectile 10, which includes fuselage 12, slots 14, flight surfaces 16 (shown in the deployed position), membranes 18, and cutters 20. FIG. 2A is a perspective view of a portion of projectile 10, with flight surfaces 16 in a stowed, prelaunch position. FIG. 2B is the same view as FIG. 2A, except flight surfaces 16 are in a deployed, post-launch position.

As shown in FIGS. 1-2B, fuselage 12 forms an outer housing or casing for at least a portion of projectile 10. Referring to FIG. 2A, flight surfaces 16 are completely housed and stowed within fuselage 12 in a starting position prior to the launch of projectile 10. While in the starting position, projectile 10 has a substantially cylindrical profile, which allows projectile 10 to be launched from a tube launcher or the like, and also allows easier storage and handling of projectile 10. Slots 14 are formed in fuselage 12 and are sized so as to allow flight surfaces 16 to swing and extend out of fuselage 12 in a deployed position. Each of slots 14 is elongated along an axial length of projectile 10 and extends between first end 24 and second end 26. Flight surfaces 16 in the embodiment of FIGS. 1-2B are wings and canards that include hinges 22 connecting flight surfaces 16 to an interior of fuselage 12. In other embodiments, flight surfaces 16 can include airfoils and fins. Flight surfaces 16 stabilize and/or guide the flight and trajectory of projectile 10. Flight surfaces 16 can be translated from the stowed starting position (FIG. 2A) to the deployed position (FIGS. 1 and 2B) by actuators (not shown) inside fuselage 12.

To protect the interior of fuselage 12 from the ingress of particles and contaminates, slots 14 are covered by membranes 18 which are attached onto fuselage 12. Membranes 18 can be formed from polymer and/or foil, or any other flexible skin-like material that can be adhered to fuselage 12 over slots 14. Membranes 18 form the ideal cover for slots 14 as membranes 18 are inexpensive and readily conform to the contours of fuselage 12. The material of membranes 18 is strong enough that flight surfaces 16 alone cannot slice or cut through membranes 18 when actuated by the usual force to the deployed position. Since the actuation force of flight surfaces 16 is insufficient to slice or cut through membranes 18, membranes 18 prevent flight surfaces 16 from deploying out of fuselage 12 prematurely.

Cutters 20 are provided to slice membranes 18 during launch or after launch of projectile 10. As shown in FIGS. 1-2B, cutters 20 are adjacent membranes 18 respectively, and move in slots 14 respectively to slice membranes 18 to open slots 14 and allow deployment of flight surfaces 16 through slots 14. As shown in FIG. 2A, each of cutters 20 is initially positioned at first end 24 of respective slot 14 and membrane 18 is unopened. During launch or after launch of projectile 10, cutters 20 move from first end 24 to second end 26 of their respective slots 14, slicing membranes 18 as cutters 20 move. After cutters 20 slice membranes 18, flight surfaces 16 can deploy through slots 14. As discussed below with reference to FIG. 3, cutters 20 in the embodiments of FIGS. 1-2B are weighted so that cutters 20 are energized and move from first end 24 to second end 26 of their respective slots 14 by setback forces generated through the high accelerations of projectile 10 during launch. Setback force is herein defined as the rearward force of inertia which is created by the forward acceleration of projectile 10 during its launching phase. As a principle of physics, setback forces are directly proportional to the acceleration and mass of the parts being accelerated.

Figure 3:
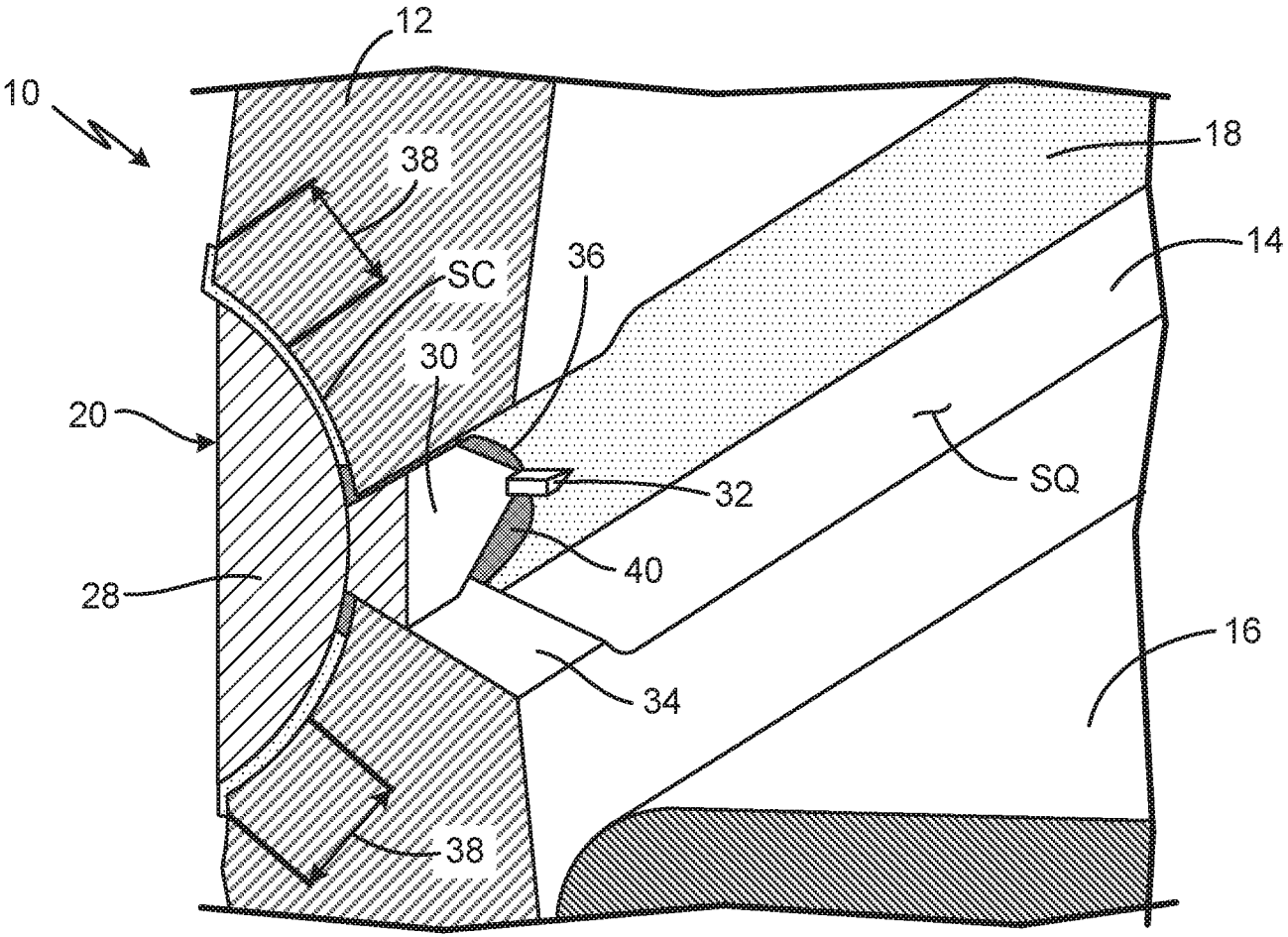
FIG. 3 is a cross-sectional perspective view of the weighted cutter, the cover, and a fuselage or outer housing of the projectile from FIG. 2A taken along line A-A.

FIG. 3 is a cross-sectional perspective view of fuselage 12 from FIG. 2A taken along line A-A, showing slot 14, flight surface 16, membrane 18, and cutter 20. As shown in FIG. 3, cutter 20 includes weight 28, dovetail root 30, and blade 32. Slot 14 includes dovetail groove 34 at first end 24 (shown in FIGS. 1-2B) of slot 14. Membrane 18 includes hole 36, adhesive section 38, and filler 40.

In the embodiment of FIG. 3, slot 14 includes a semi-circular cross-sectional profile SC that extends partially through fuselage 12 from the outside, which narrows and transitions to a generally rectangular cross-sectional profile SQ before reaching the interior of fuselage 12. The rectangular cross-sectional profile SQ of slot 14 transitions into dovetail groove 34 at first end 24 of slot 14. Membrane 18 is attached onto the outside of fuselage 12 over slot 14.

An outer perimeter of membrane 18 is at least larger than a perimeter of the portion of slot 14 defined by rectangular cross-sectional profile SQ. In the embodiment of FIG. 3, the outer perimeter of membrane 18 is larger than an outer perimeter slot 14. Adhesive section 38 is a portion of membrane 18 that is bonded to fuselage 12 by a layer of adhesive. In the embodiment of FIG. 3, adhesive section 38 extends along the outer perimeter of membrane 18 and extends on membrane 18 from the outer perimeter to an extent midway between the outer perimeter of membrane 18 and the portion of slot 14 defined by rectangular cross-sectional profile SQ. Because only a portion of membrane 18 contacting fuselage 12 is bonded to fuselage 12, the portions of membrane 18 not bonded can flex and bend when flight surface 16 is deployed through slot 14 after membrane 18 is sliced by cutter 20. In this way, the sliced edges of membrane 18 cause less resistance against flight surface 16 during deployment than had all of membrane 18 contacting fuselage 12 been bonded to fuselage 12.

Weight 28 provides the majority of the mass of cutter 20 and is positioned in the semi-circular profile SC of slot 14 over membrane 18. To conform to slot 14, weight 28 of cutter 20 also includes a semi-circular profile. When cutter 20 moves from first end 24 to second end 26 of slot 14, weight 28 slides in the semi-circular profile SC of slot 14 on membrane 18. Dovetail root 30 extends radially inward from weight 28 through membrane 18 and into slot 14. Dovetail root 30 includes a wedge-shaped cross-sectional profile that corresponds with the profile of dovetail groove 34. When cutter 20 is positioned at first end 24 of slot 14 in a starting position, dovetail root 30 is received by dovetail groove 34. Dovetail root 30 mates with dovetail groove 34 and prevents cutter 20 from falling out of slot 14 before projectile 10 is launched. Blade 32 also extends radially inward from weight 28 and through membrane 18. In the embodiment of FIG. 3, blade 32 is connected to dovetail root 30. To accommodate dovetail root 30 and blade 32 during assembly, membrane 18 includes hole 36 near first end 24 and dovetail groove 34 of slot 14. After dovetail root 30 and blade 32 are inserted into hole 36 and dovetail root 30 is mated with dovetail groove 34, hole 36 is closed and sealed by filler 40. Filler 40 can also extend between dovetail root 30 and dovetail groove 34 to form a relatively weak bond that keeps dovetail root 30 from exiting dovetail groove 34 before launch of projectile 10. Filler 40 can be a waxed-based product, or any other product that can seal hole 36 and bond dovetail root 30 to dovetail groove 34, but whose bond will break under the setback forces generated through the high accelerations of projectile 10 during launch.

Prior to launch of projectile 10, as embodied in FIGS. 1-3, projectile 10 is loaded into a tube launcher or the like (not shown). At launch, projectile 10 rapidly accelerates forward, inducing setback forces on weight 28 in the opposite direction. The setback forces induced by the acceleration of projectile 10 and the mass of weight 28 break the filler bonding dovetail root 30 to dovetail groove 34, and weight 28 begins to slide in slot 14 on membrane 18 from first end 24 to second end 26 of slot 14. As weight 28 slides from first end 24 to second end 26, the setback forces are strong enough that blade 32 of cutter 20 slices membrane 18. Cutter 20 reaches second end 26 of slot 14 before projectile 10 exits the tube launcher (not shown), and after projectile 10 exits the tube launcher, cutter 20 can fall out of slot 14, reducing the overall weight of projectile 10. With membrane 18 sliced open by cutter 20 and projectile 10 clear of the tube launcher, flight surface 16 can actuate and extend through slot 14 to the deployed position (shown in FIGS. 1 and 2B). While the embodiment of FIGS. 1-3 disclose cutter 20 with weight 28, cutter 20 in other embodiments can be moved in slot 14 by an actuator, as discussed below with reference to the embodiment of FIGS. 4A-6.

Figure 4A:
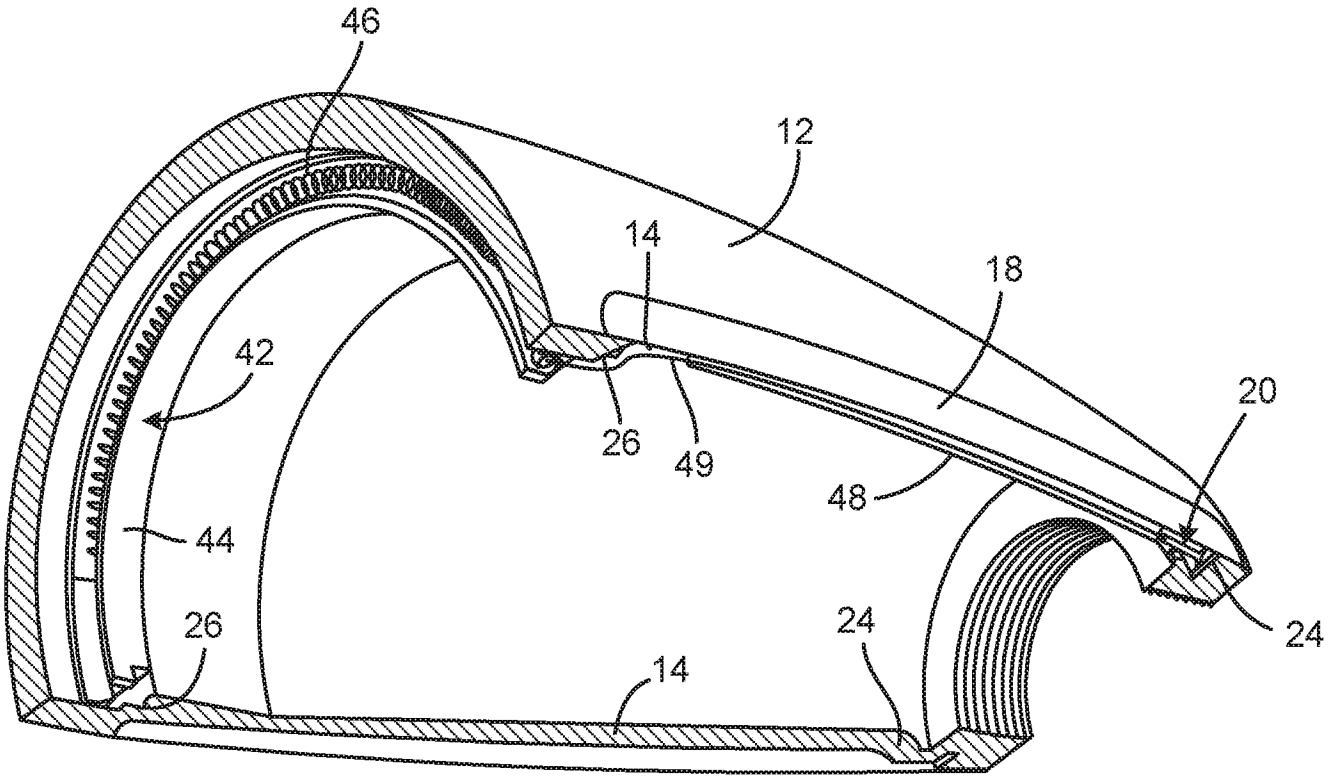
FIG. 4A is a cross-sectional perspective view of a projectile fuselage portion with a slot, a cover sealing the slot, a cutter, and a spring actuator for the cutter.
Figure 4B:
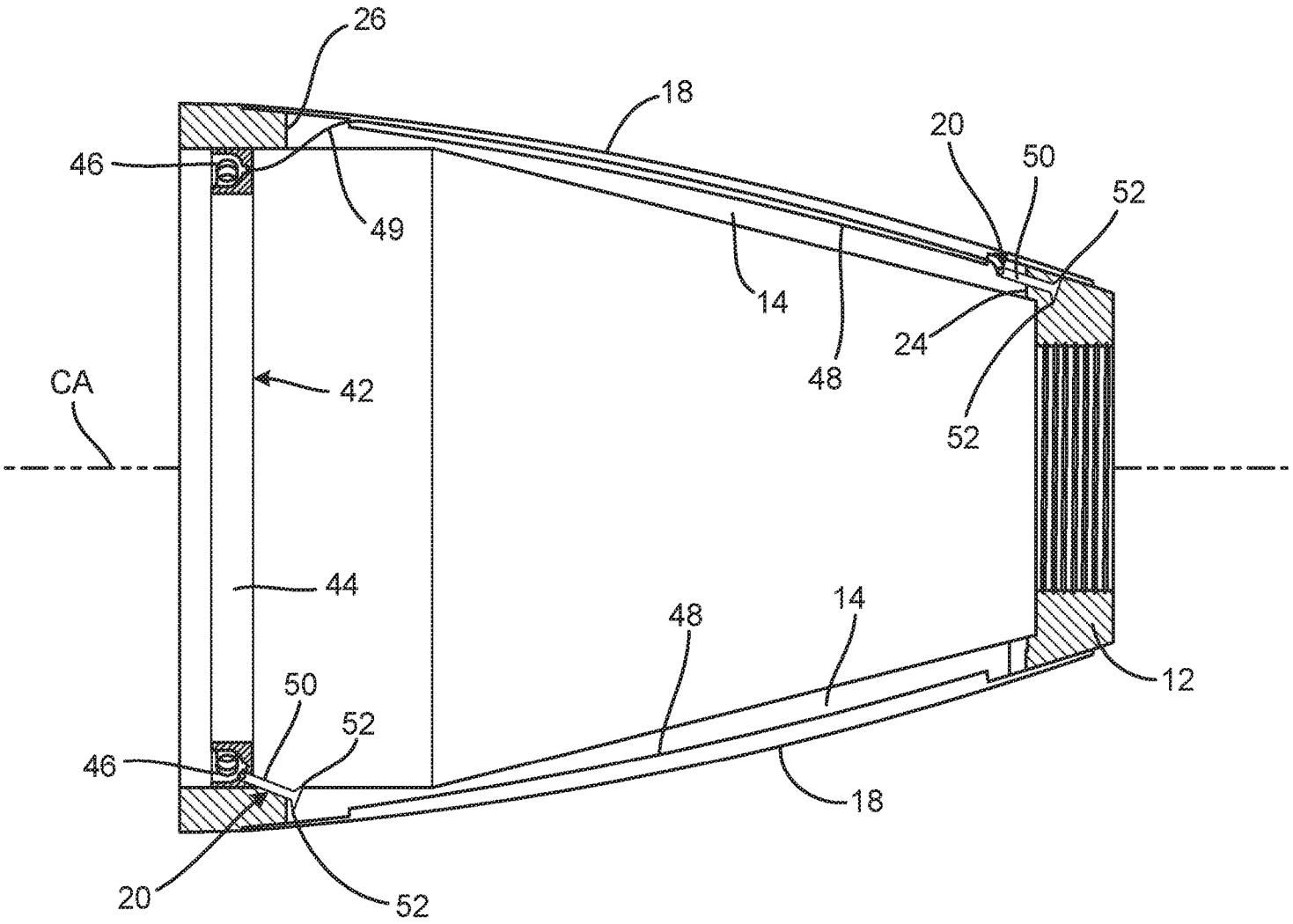
FIG. 4B is a cross-sectional view of the projectile fuselage portion from FIG. 4A.
Figure 5A:
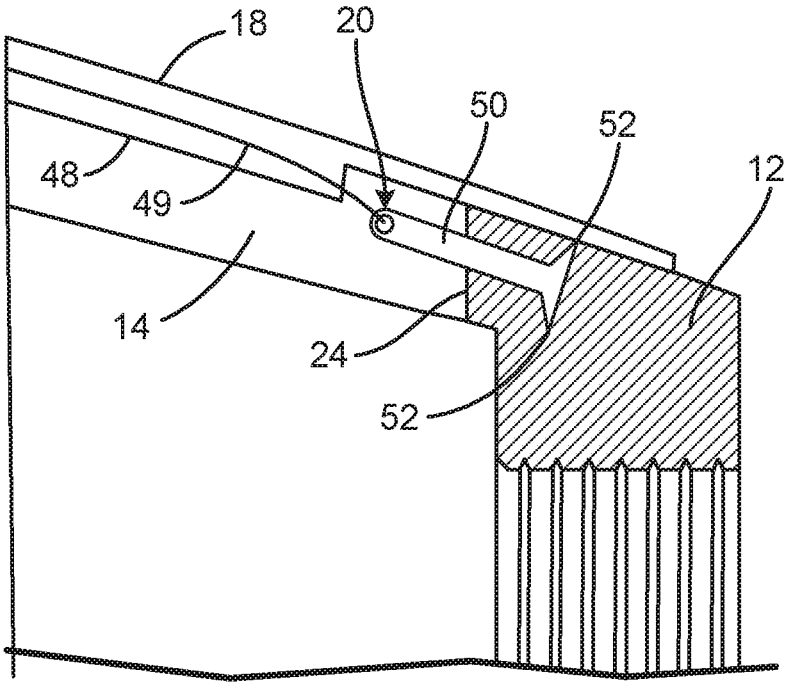
FIG. 5A is an enlarged cross-sectional view of the fuselage portion from FIG. 4B showing the cutter in a starting position.
Figure 5B:
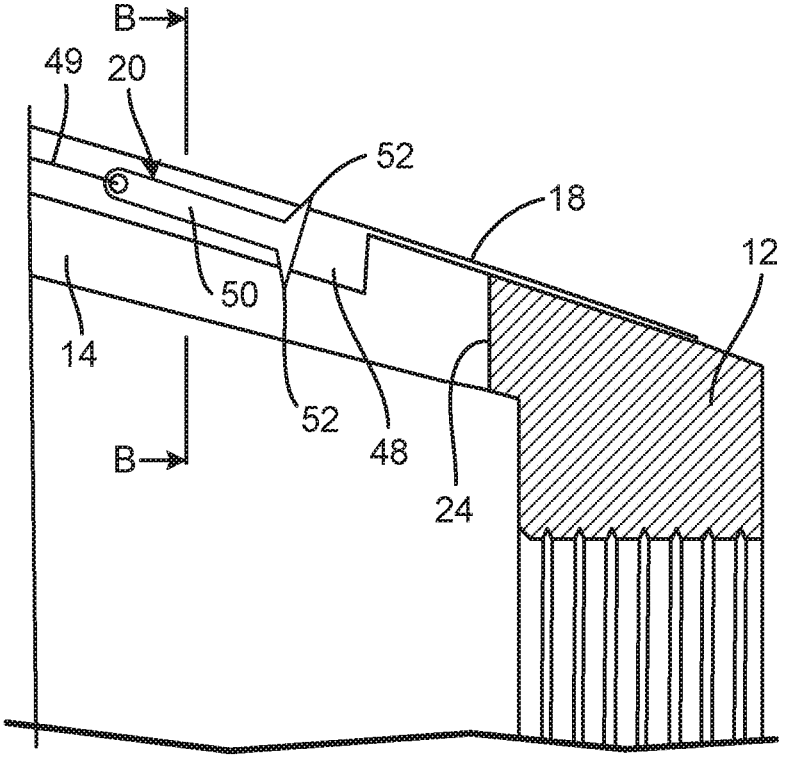
FIG. 5B is another enlarged cross-sectional view of the fuselage portion from FIG. 4B showing the cutter moving toward a second end of the slot and cutting the cover.
Figure 6:
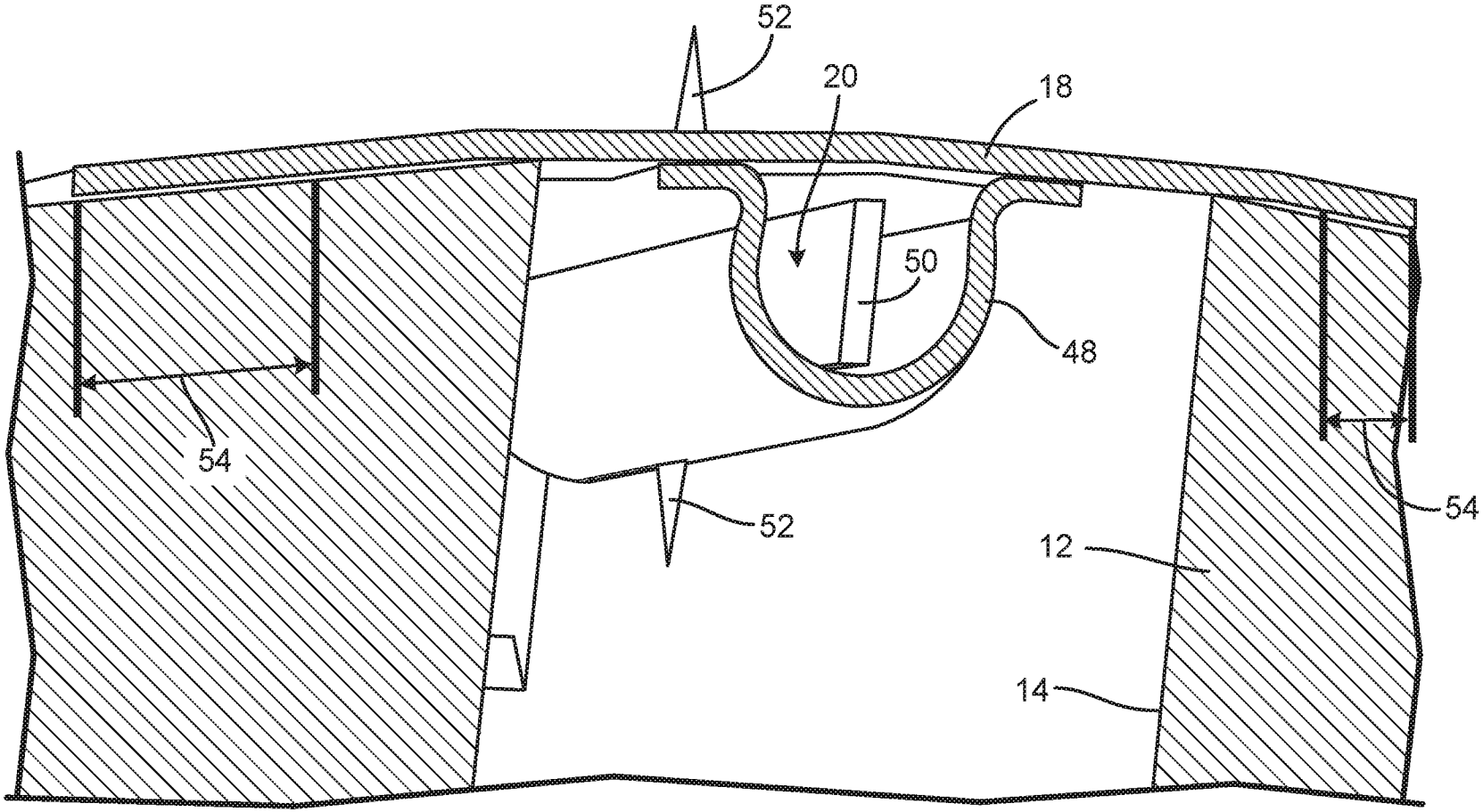
FIG. 6 is a cross-section view of the cover, the slot, and the fuselage portion from FIG. 5B taken along line B-B.

FIGS. 4A-6 show various views of the same embodiment and will be discussed concurrently. FIG. 4A is a cross-sectional perspective view of fuselage portion 12 for a projectile. FIG. 4B is a cross-sectional view of fuselage portion 12 from FIG. 4A. FIG. 5A is an enlarged cross-sectional view of fuselage portion 12 from FIG. 4B showing cutter 20 in a starting position, and FIG. 5B is the same view as FIG. 5A except with cutter 20 moving toward second end 26 of slot 14 and cutting membrane 18. FIG. 6 is a cross-section view of membrane 18, slot 14, and fuselage portion 12 from FIG. 5B taken along line B-B. Actuator 42 is best shown in FIGS. 4A and 4B. Actuator 42 includes track 44, spring 46, and line 49. Membrane 18 includes tube 48 and adhesive section 54. Cutter 20 includes body 50 and blades 52.

In the embodiment of FIGS. 4A-6, slot 14 extends radially through fuselage portion 12, and extends axially from first end 24 to second end 26. Membrane 18 is attached to fuselage portion 12 and completely covers slot 14. As shown in FIGS. 4A and 4B, track 44 extends circumferentially inside fuselage portion 12 at least partially around center axis CA. Spring 46 is a coil spring inside track 44 that extends at least partially around center axis CA inside track 44. In the embodiment of FIGS. 4A and 4B, track 44 and spring 46 are positioned proximate second end 26 of slot 14. Line 49 is a string, wire, or cable that connects an end of spring 46 to cutter 20. Line 49 is connected to body 50 of cutter 20 opposite blades 52. Blades 52, which are two in number, extend from body 50 to give cutter 20 a T-shaped profile.

Shown best in FIG. 6, tube 48 of membrane 18 is formed on an inside surface of membrane 18 (the surface of membrane 18 facing radially inward into fuselage portion 12). Tube 48 is formed by bonding a second sheet of the same or similar material forming membrane 18 in a U-shape to the inside surface of membrane 18. Line 49 extends through tube 48 so that actuator 42 can pull body 50 of cutter 20 through tube 48. Tube 48 is sized to receive body 50 of cutter 20, but is small enough that blades 52 extend through and slice membrane 18 and tube 48 as actuator 42 pulls cutter 20 from first end 24 to second end 26 of slot 14. Tube 48 ensures that blade 52 of cutter 20 maintains contact with membrane 18 by constraining the orientation of cutter body 50 as spring 46 of actuator 42 pulls cutter 20 from first end 24 to second end 26 of slot 14.

As shown best in FIG. 6, an outer perimeter of membrane 18 is larger than a perimeter of slot 14. Adhesive section 54 is a portion of membrane 18 that is bonded to fuselage portion 12 by a layer of adhesive. In the embodiment of FIG. 6, adhesive section 54 extends along the outer perimeter of membrane 18 and extends on membrane 18 from the outer perimeter to an extent midway between the outer perimeter of membrane 18 and the perimeter of slot 14. Because only a portion of membrane 18 contacting fuselage portion 12 is bonded to fuselage portion 12, the portions of membrane 18 not bonded can flex and bend when a flight surface (not shown) is deployed through slot 14 after membrane 18 is sliced by cutter 20. In this way, the sliced edges of membrane 18 cause less resistance against the flight surface during deployment than had all of membrane 18 contacting fuselage portion 12 been bonded to fuselage portion 12. In other embodiments, adhesive can be applied to all of the area of membrane 18 between the outer perimeter of membrane 18 and the perimeter of slot 14.

In view of the foregoing description, it will be recognized that the present disclosure provides numerous advantages and benefits. For example, the present disclosure membranes 18 that cover slots 20 of projectile 10 and protect the interior of projectile 10 from contamination before projectile 10 is launched. The present disclosure also provides cutters 20 that open membranes 18 as or after projectile 10 is launched. Both membranes 18 and cutters 20 are simple, low-weight, and cost-effective in comparison to the previously described prior art.

The following are non-exclusive descriptions of possible embodiments of the present invention.

In one embodiment, a projectile includes a fuselage and a slot formed in the fuselage. The projectile also includes a flight surface deployable from an inside of the fuselage to an outside of the fuselage. A membrane is attached to the fuselage and covers the slot. A cutter is positioned and configured to move along a length of the slot to slice the membrane to allow deployment of the flight surface through the slot.

The projectile of the preceding paragraph can optionally include, additionally and/or alternatively, any one or more of the following features, configurations and/or additional components:

- the cutter comprises: a weight positioned near the slot and configured to move relative to the projectile along the length of the slot in response to acceleration of the projectile; and the cutter extending from the weight and configured to move with the weight;
- the slot comprises a dovetail groove at a first end of the slot and the cutter comprises a dovetail root connected to the weight and extending through the membrane, and wherein the dovetail root is positioned inside the dovetail groove when the cutter is in a starting position;
- an actuator inside the fuselage and connected to the cutter and configured to move the cutter from a first end of the slot to a second end of the slot;
- the actuator comprises: a track extending circumferentially inside the fuselage at least partially around a center axis of the projectile; a spring inside the track and extending at least partially around the center axis of the projectile; and a line extending between the spring and the cutter, wherein the line connects the spring to the cutter;
- the cutter comprises: a body; and at least one blade extending from the body, wherein the line is connected to the body;
- the membrane comprises: a first surface opposite a second surface; a tube formed on the first surface or the second surface of the membrane, wherein the line extends through the tube, and the tube is sized to receive the body of the cutter; and/or the deployable flight surface is a fin, a wing, a canard, or an airfoil.

In another embodiment, a projectile includes a housing and a slot formed in the housing. A deployable flight surface is inside the housing. A cover is attached to the housing and covers the slot. A cutter is adjacent the cover and moves in the slot and slices the cover to open the slot and allow deployment of the flight surface through the slot.

The projectile of the preceding paragraph can optionally include, additionally and/or alternatively, any one or more of the following features, configurations and/or additional components:

an actuator inside the housing and connected to the cutter, wherein the actuator is configured to pull the cutter from a first end of the slot to a second end of the slot;

the actuator comprises: a track extending circumferentially inside the housing at least partially around a center axis of the projectile; a spring inside the track and extending at least partially around the center axis of the projectile; and a line extending between the spring and the cutter, wherein the line connects the spring to the cutter;

the cutter comprises: a body; and at least one blade extending from the body, wherein the line is connected to the body;

the cover comprises: a first surface facing radially outward from the projectile; a second surface facing radially inward into the projectile; and a tube formed on the second surface of the cover, wherein the line extends through the tube, and the tube is sized to receive the body of the cutter;

the cutter comprises: a weighted body positioned in the slot on the cover; and a blade extending from the weighted body through the cover;

the slot comprises a dovetail groove at a first end of the slot and the cutter comprises a dovetail root connected to the weighted body and positioned inside the dovetail groove when the cutter is in a starting position;

a wax seal is disposed between the dovetail groove and the dovetail root; and/or the cover comprises: a membrane with an outer perimeter larger than a perimeter of the slot; a layer of adhesive extending along the outer perimeter of the membrane and extending on the membrane from the outer perimeter to an extent midway between the outer perimeter of the membrane and the perimeter of the slot.

In another embodiment, a method for deploying a flight surface through a slot formed on the outer housing of a guided projectile includes moving a cutter from a first end of the slot to a second end of the slot and slicing a membrane covering the slot as the cutter moves from the first end of the slot to the second end of the slot. The method also includes extending the flight surface through the sliced membrane and the slot.

The method of the preceding paragraph can optionally include, additionally and/or alternatively, any one or more of the following features, configurations and/or additional components:

weighting the cutter and moving the cutter from the first end of the slot to the second end of the slot when the projectile accelerates; and/or the cutter is pulled from the first end of the slot to the second end of the slot by a spring inside the outer housing.

Any relative terms or terms of degree used herein, such as "substantially", "essentially", "generally", "approximately", and the like, should be interpreted in accordance with and subject to any applicable definitions or limits expressly stated herein. In all instances, any relative terms or terms of degree used herein should be interpreted to broadly encompass any relevant disclosed embodiments as well as such ranges or variations as would be understood by a person of ordinary skill in the art in view of the entirety of the present disclosure, such as to encompass ordinary manufacturing tolerance variations, incidental alignment variations, transitory vibrations and sway movements, temporary alignment or shape variations induced by operational conditions, and the like.

While the invention has been described with reference to an exemplary embodiment(s), it will be understood by those skilled in the art that various changes may be made and equivalents may be substituted for elements thereof without departing from the scope of the invention. For example, while FIGS. 1 through 6 show membrane 18 attached to an exterior surface of fuselage 10, membrane 18 can be attached to an interior surface of fuselage 10. In addition, many modifications may be made to adapt a particular situation or material to the teachings of the invention without departing from the essential scope thereof. For example, while projectile 10, membrane 18, and cutter 20 have been described with reference tube launchers, projectile 10 can be adapted for other launching systems, such as wing or hatch mounted missiles launched from aircraft. In another example, tube 48 in the embodiment of FIGS. 4A-6 can be replaced by a track attached to the side of slot 14 to guide cutter 20 across slot 14 and maintain contact with membrane 18. Therefore, it is intended that the invention not be limited to the particular embodiment(s) disclosed, but that the invention will include all embodiments falling within the scope of the appended claims.

The invention claimed is:

1. A projectile comprising:

a fuselage;

a slot formed in the fuselage;

a flight surface deployable from an inside of the fuselage to an outside of the fuselage;

a membrane attached to the fuselage and covering the slot; and a cutter positioned and configured to move along a length of the slot to slice the membrane to allow deployment of the flight surface through the slot.

2. The projectile of claim 1, wherein the cutter comprises:

a weight positioned near the slot and configured to move relative to the projectile along the length of the slot in response to acceleration of the projectile; and the cutter extending from the weight and configured to move with the weight.

3. The projectile of claim 2, wherein the slot comprises a dovetail groove at a first end of the slot and the cutter comprises a dovetail root connected to the weight and extending through the membrane, and wherein the dovetail root is positioned inside the dovetail groove when the cutter is in a starting position.

4. The projectile of claim 1, further comprising:

an actuator inside the fuselage and connected to the cutter and configured to move the cutter from a first end of the slot to a second end of the slot.

5. The projectile of claim 4, wherein the actuator comprises:

a track extending circumferentially inside the fuselage at least partially around a center axis of the projectile;

a spring inside the track and extending at least partially around the center axis of the projectile; and a line extending between the spring and the cutter, wherein the line connects the spring to the cutter.

6. The projectile of claim 5, wherein the cutter comprises:

a body; and at least one blade extending from the body, wherein the line is connected to the body.

7. The projectile of claim 6, wherein the membrane comprises:

a first surface opposite a second surface;

a tube formed on the first surface or the second surface of the membrane, wherein the line extends through the tube, and the tube is sized to receive the body of the cutter.

8. The projectile of claim 1, wherein the deployable flight surface is a fin, a wing, a canard, or an airfoil.

9. A projectile comprising:

a housing;

a slot formed in the housing;

a deployable flight surface inside the housing;

a cover attached to the housing and covering the slot; and a cutter adjacent the cover, wherein the cutter moves in the slot and slices the cover to open the slot and allow deployment of the flight surface through the slot.

10. The projectile of claim 9, further comprising:

an actuator inside the housing and connected to the cutter, wherein the actuator is configured to pull the cutter from a first end of the slot to a second end of the slot.

11. The projectile of claim 10, wherein the actuator comprises:

a track extending circumferentially inside the housing at least partially around a center axis of the projectile;

a spring inside the track and extending at least partially around the center axis of the projectile; and a line extending between the spring and the cutter, wherein the line connects the spring to the cutter.

12. The projectile of claim 11, wherein the cutter comprises:

a body; and at least one blade extending from the body, wherein the line is connected to the body.

13. The projectile of claim 12, wherein the cover comprises:

a first surface facing radially outward from the projectile;

a second surface facing radially inward into the projectile; and a tube formed on the second surface of the cover, wherein the line extends through the tube, and the tube is sized to receive the body of the cutter.

14. The projectile of claim 9, wherein the cutter comprises:

a weighted body positioned in the slot on the cover; and a blade extending from the weighted body through the cover.

15. The projectile of claim 14, wherein the slot comprises a dovetail groove at a first end of the slot and the cutter comprises a dovetail root connected to the weighted body and positioned inside the dovetail groove when the cutter is in a starting position.

16. The projectile of claim 15, wherein a wax seal is disposed between the dovetail groove and the dovetail root.

17. The projectile of claim 9, wherein the cover comprises:

a membrane with an outer perimeter larger than a perimeter of the slot;

a layer of adhesive extending along the outer perimeter of the membrane and extending on the membrane from the outer perimeter to an extent midway between the outer perimeter of the membrane and the perimeter of the slot.

18. A method of deploying a flight surface through a slot formed on the outer housing of a guided projectile, the method comprising: moving a cutter from a first end of the slot to a second end of the slot; slicing a membrane covering the slot as the cutter moves from the first end of the slot to the second end of the slot; extending the flight surface through the sliced membrane and the slot.

19. The method of claim 18, further comprising:

weighting the cutter and moving the cutter from the first end of the slot to the second end of the slot when the projectile accelerates.

20. The method of claim 18, wherein the cutter is pulled from the first end of the slot to the second end of the slot by a spring inside the outer housing.

* * * * *